US005465955A

United States Patent [19]

Krupica et al.

[11] Patent Number: 5,465,955

[45] Date of Patent: Nov. 14, 1995

[54] METHOD AND APPARATUS FOR AN EXTERNAL MEDIA BUFFER

[75] Inventors: Libor Krupica, Methuen; William L. McElwain, Lowell, both of Mass.

[73] Assignee: Bayer Corporation, Wilmington, Mass.

[21] Appl. No.: 287,436

[22] Filed: Aug. 8, 1994

[51] Int. Cl.[6] ..... B65H 7/02

[52] U.S. Cl. ..... 271/265.02; 271/268; 271/270; 271/272; 271/176; 271/81; 271/85

[58] Field of Search ..... 271/267, 268, 271/270, 272, 265, 306, 176, 81, 82, 84, 85, 300

[56] References Cited

U.S. PATENT DOCUMENTS

| | | | |
|---|---|---|---|
| 4,580,774 | 4/1986 | Yamaguchi et al. | 271/81 |
| 5,110,104 | 5/1992 | Wakao et al. | 271/84 |

OTHER PUBLICATIONS

Dornberger et al, Clutch–Brake Speed Control, Jan. 1976 Western Electric Technical Digest No. 41, pp. 7–8.

*Primary Examiner*—H. Grant Skaggs
*Attorney, Agent, or Firm*—Julie A. Krolikowski

[57] ABSTRACT

An external media transport buffer has a carriage supported for linear motion on parallel guide rails between an imagesetter and a processor. A pair of transport rollers is mounted for rotation on the carriage. Two sensors are mounted within the buffer to detect media movement. A first sensor is positioned at an entrance to the buffer and a second sensor is positioned on the carriage on an exit side of the transport rollers. Signals are sent from the sensors to a roller transport motor and carriage transport motor and the signals are coordinated to start and stop the motors according to a predetermined sequence. A leading end of media enters the nip of the transport rollers and is held in the nip as the carriage travels from the imagesetter to the processor. A slack loop of media forms between the carriage and the imagesetter as the imagesetter feeds the media to the buffer faster than the carriage travels to the processor. A movable media guide is used in a first position to guide the media from the imagesetter into the nip of the transport rollers. As the carriage begins to travel away from the imagesetter and the leading end of the media is held in the roller nip, the movable guide drops down to a second position so that the slack loop may form easily and buckling and jerking of the media is avoided. Upon the trailing end of the media entering the buffer and a ready signal from the processor, the transport rollers deliver the leading end of media into the processor transport rollers. Upon complete removal of the media by the processor, the carriage returns to the imagesetter and the movable media guide returns to its initial position.

14 Claims, 5 Drawing Sheets

METHOD AND APPARATUS FOR AN EXTERNAL MEDIA BUFFER

BACKGROUND OF THE INVENTION

The invention is related to media handling and transport systems, and more specifically to systems used in the imaging technology industry to temporarily store and transport photosensitive media between an image-setting device and an image-processing device. The image-setting and image-processing devices are each equipped with internal media transport systems designed to handle and transport the media within that particular device at the operating speed required by that device. Typically the media transport system of the image-setting device operates at a faster speed than that of the image-processing device. This poses a problem when the two devices are used together in an on-line operating mode, in which the media is transported directly from the image-setting device to the image-processing device rather than to an intermediate storage take-up cassette that is transferred manually from one device to the other. In the on-line operating mode, the media needs to be buffered between the image-setting device and the image-processing device because of the difference in operating speeds of the respective media transport systems. During on-line operation it is desirable to avoid down time of the image-setting device due to a slower operating speed of the image-processing device. It is also desirable to minimize the amount of floor space used by an on-line operating system. It is further desirable to minimize the cost of an on-line operating system.

Another problem encountered in media transporting systems is caused by the thickness and stiffness of the media. Plate materials having a thickness of approximately 12 mils (1 mil=1/1000 inch) are more difficult to handle in media transport systems compared to media 4 mils thick. Because this media is stiffer and harder to bend, generally a media transport path requires a large radius of curvature. Further, an inherent curvature at the leading end of a media supply or sheet causes difficulties with media loading. Sudden buckling and/or misfeeding due to the natural curl of the media can occur and disrupt the media handling or imaging as a result. It is therefore advantageous to prevent buckling and misguiding of the media during loading of media into a media handling system.

In view of the above difficulties encountered in media handling and transport systems, it is accordingly a general object of the invention to provide an external media transport mechanism for buffering media between an image-setting device and an image-processing device used together in an on-line operating mode.

It is an object of the invention to minimize the amount of floor space required by an external media transport mechanism used with an image-setting device and an image-processing device in an on-line operating mode.

It is further an object of the invention to accommodate media of varying stiffness and thickness during loading of the media into an external media transport mechanism and thereby prevent buckling of the media during transport.

SUMMARY OF THE INVENTION

A method and apparatus for buffering a sheet of media between a first media handling station and a second media handling station employ a gripping mechanism for gripping the leading end of the sheet as the sheet advances at a first speed from the first media handling station. A first transport system transports the gripping mechanism and the leading end of the sheet at a second speed, from the first media handling station to the second media handling station. The second speed is slower than the first speed and as a result the sheet of media forms a slack loop during transportation of the gripping mechanism and the leading end of the sheet to the second media handling station, until the trailing end of the sheet advances out from the first media handling station. A second transporting system transports the sheet to the second media handling station from the leading end to the trailing end of the sheet upon the gripping mechanism releasing the leading end.

BRIEF DESCRIPTION OF THE DRAWINGS

The features and objects of the invention will become apparent in the following description taken in connection with the accompanying drawings, in which.

DESCRIPTION OF THE PREFERRED EMBODIMENT

Figure 1A:
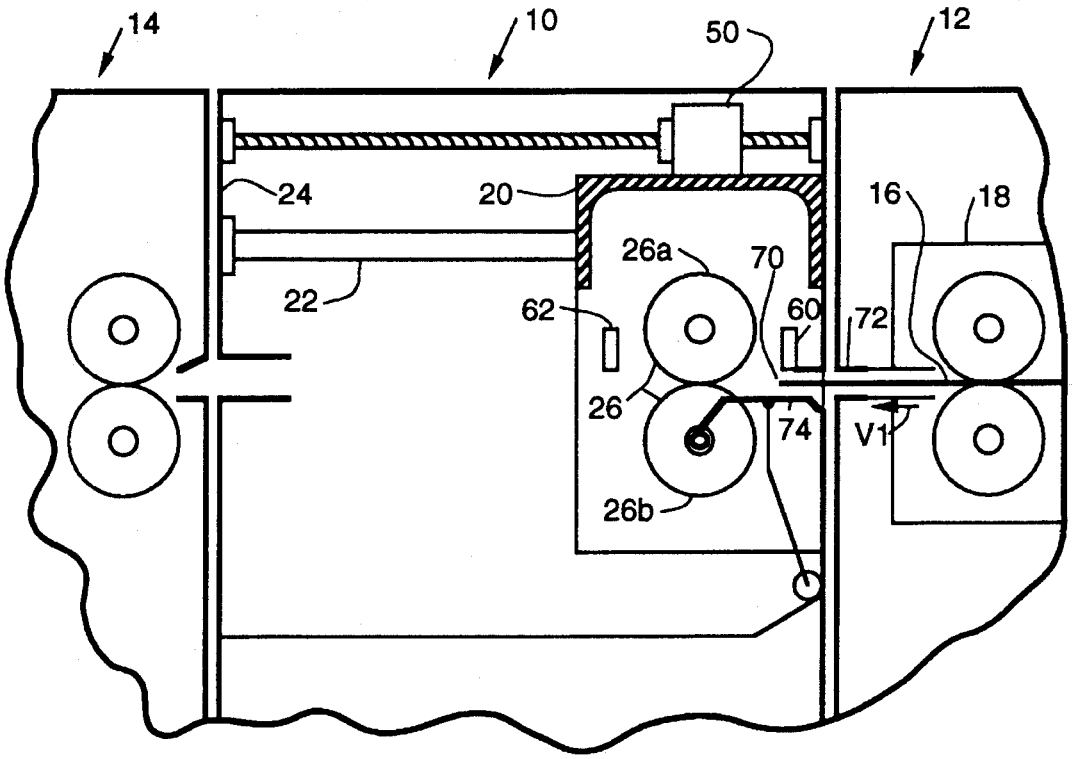
FIGS. 1A–D are sequential partial sectional side views of the stages of operation of an external buffer according to the invention in combination with an imagesetter and a processor.
Figure 2:
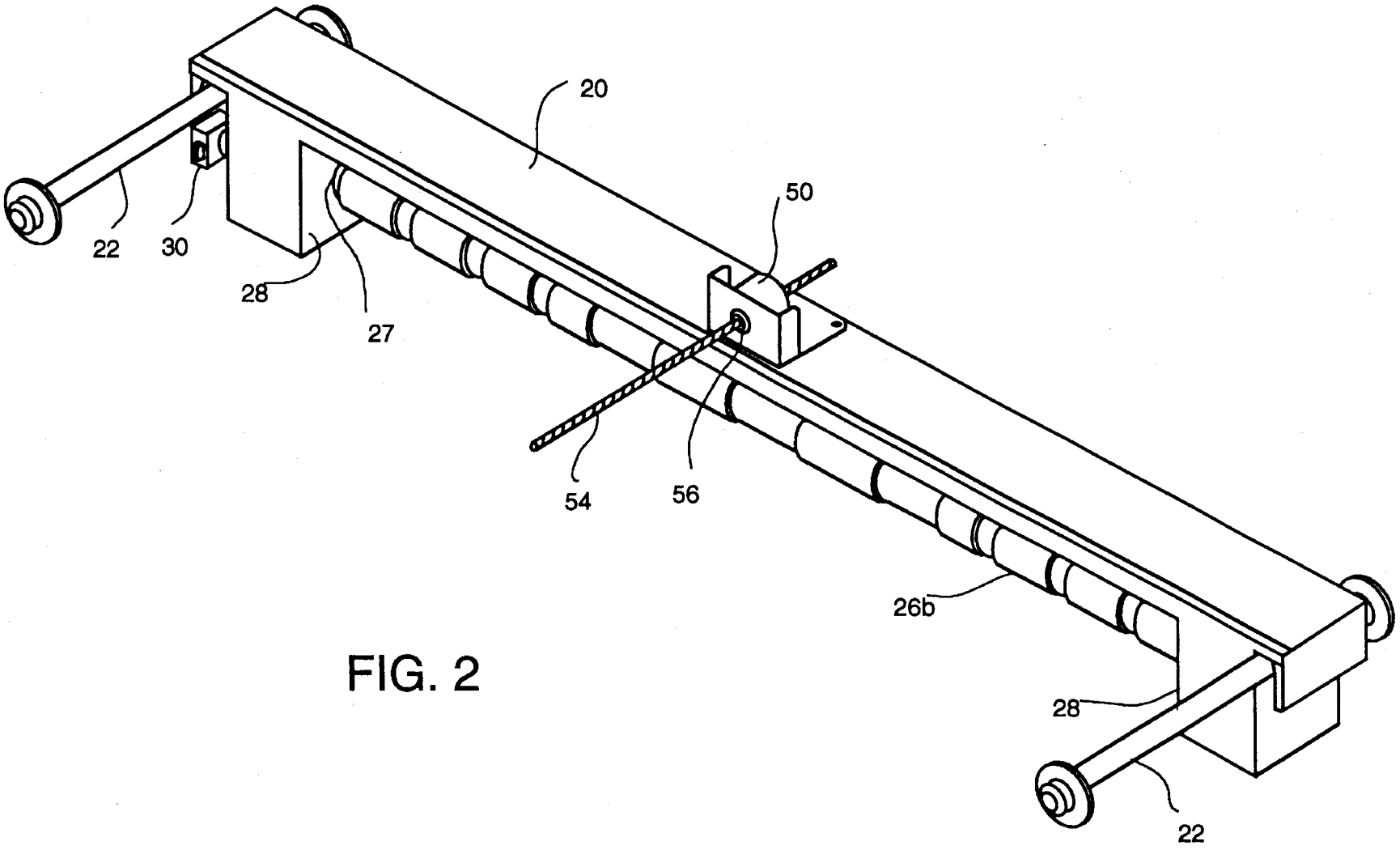
FIG. 2 is an illustrative view of an external buffer according to the invention.

Referring to FIGS. 1A and 2 it is shown that an external media buffer, generally indicated as 10, is positioned between an imagesetter, generally referred to as 12, and a processor, generally referred to as 14. In the imagesetter 12, media 16 is fed from a continuous web supply roll to a recording support surface to be imaged and then delivered as cut sheets into the buffer 10 by a media transport system 18.

The buffer 10 has a carriage 20 which is supported for linear motion on two horizontally spaced parallel guide rails 22. The guide rails 22 traverse a width spanning between the imagesetter 12 and the processor 14. The guide rails 22 are attached to the interior of a buffer housing 24 or may alternatively be directly attached to the exterior of the imagesetter 12 and the processor 14, respectively. A pair of media transport rollers 26 is mounted within the carriage 20 in a direction lengthwise perpendicular to the guide rails 22. The rollers 26 are positioned vertically below and in between the guide rails 22 and are mounted for rotation by bearings 27 mounted within the carriage end plates 28, shown in FIG. 3. A drive roller **26*b* is driven by means of a motor 30 mounted on an end plate 28, while the other is an idler roller 26*a* driven through rolling contact with the drive roller 26*b* or through media movement in the nip of the rollers 26 transferring the rotation of the drive roller 26*b* to the idler roller 26*a***.

Figure 3:
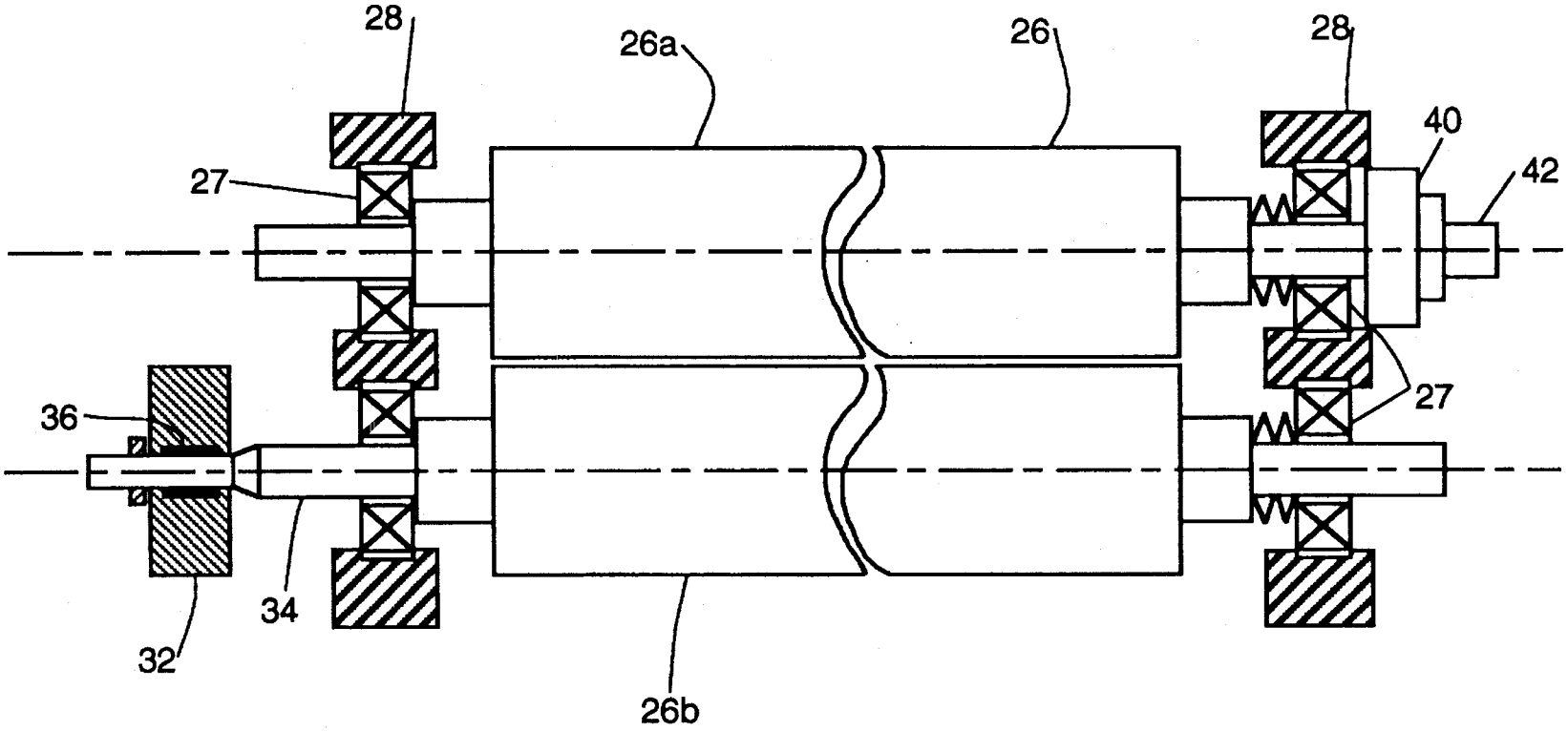
FIG. 3 is a partial sectional front view of a pair of media transport rollers used in an external buffer according to the invention.

In FIG. 3, it is shown that the drive roller **26*b* has a drive gear 32 mounted onto its end shaft 34 that is driven by a gear connection (not shown) with the motor 30. The drive gear 32 is fitted with an overrunning clutch 36 allowing the end shaft 34 and the attached drive roller 26*b* to have one-way rotation with respect to the drive gear 32. The idler roller 26*a* is equipped with a break mechanism 40 on its end shaft 42 to seize rotation of the idler roller 26***a* and consequently of roller pair 26. It will be appreciated that the break mechanism can be an electro-magnetic brake, a friction disk brake, or other suitable means for stopping rotation of the idler roller.

A carriage drive motor 50, shown in FIG. 2, is attached to a top side 52 of the carriage 20 and is engaged with a lead screw 54 that spans across the buffer housing 24 (FIG. 1A). The lead screw 54 is fixed to the interior of the buffer housing 24 parallel to the guide rails 22. The motor 50 and lead screw 54 are engaged through a nut 56 interface. The nut 56 has internal threads which engage the lead screw 54 such that when the motor 50 rotates the nut 56, the carriage 20, restricted from rotation about the lead screw 54 by engagement with the guide rails 22, is translated linearly along the guide rails 22. It will be appreciated that the carriage may alternatively be driven by a friction drive wheel in direct contact with one of the guide rails or by other suitable means.

In FIG. 1A, it is shown that two sensors 60, 62 are mounted within the buffer 10 to detect media 16 movement by means of mechanical interrupt switches. Signals from the switches are relayed to the buffer roller motor 30 and carriage motor 50 to start and stop the motors according to a predetermined sequence. A first sensor 60 is positioned at an entrance to the buffer 10 and a second sensor 62 is positioned on the carriage 20 on an exit side of the buffer rollers 26. It will be understood that the location of the first sensor can be within the image-setting device for instance if the walls between the buffer and the image-setting device are removed to integrate the two units. Further, the sensors can be mechanical interrupt switches, optical sensors or a combination of both.

Now, with reference to FIGS. 1A–1D the operation of the buffer 10 will be described. In FIG. 1A, while the carriage 20 is in a media pick-up position, a leading end 70 of media 16 is fed at speed V1 into the buffer 10 through a media guide 72 by the media transport system 18 of the imagesetter 12. The first sensor 60 senses the leading end 70 of the media entering the buffer and activates the buffer rollers 26 to rotate. A movable media guide 74 is initially in a horizontal position to serve as a guide for the media 16 into the nip of the rollers 26. The media 16 moves along the guide 74 as the leading end 70 approaches the nip of the rotating buffer rollers 26.

Figure 1B:
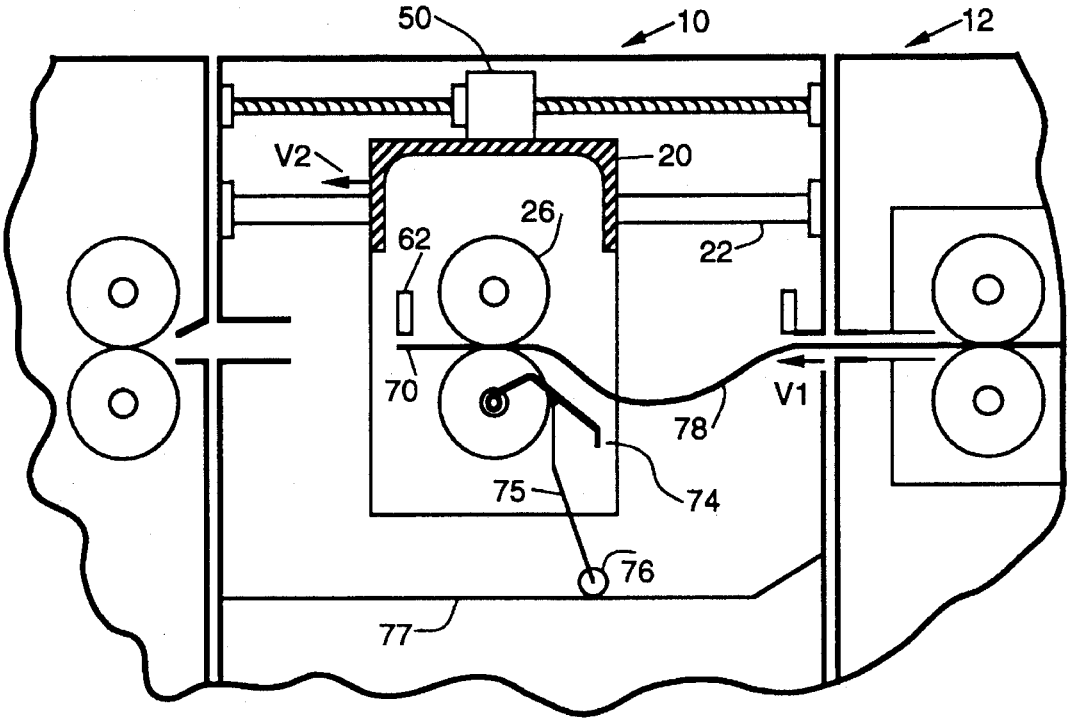

In FIG. 1B, the media 16 passes through the rollers 26 and reaches the second media sensor 62. In response to the sensor's signal, the roller motor 30 (FIG. 2) is stopped and the idler roller brake mechanism 40 is activated to stop the buffer rollers 26 from rotating and to hold the leading end 70 stationary with respect to the buffer rollers 26. Once the leading end 70 is gripped by the rollers 26, the carriage motor 50 (FIG. 2) turns on to transport the carriage 20 along the rails 22 at speed V2. The leading end 70 is held in the nip of the rollers 26 at the second media sensor 62 while speed V1 is greater than speed V2. As the carriage 20 begins to travel away from the imagesetter, the movable guide 74 automatically pivots down from the horizontal position to an angled position due to a linkage 75 between the movable guide 74 and a follower 76 that moves along a template 77 as the carriage is transported. The angled position allows a slack loop 78 to form and prevents bucking of the media in an upward direction which can result in sudden jerking of the media 16 causing media jams in the transport system of the imagesetter or wrinkling of the media. The slack loop 78 grows larger as the leading end 70 is held between the buffer rollers 26 and the media 16 continues to enter the buffer 10 from the imagesetter 12. It will be appreciated that the movable media guide can alternatively be pivotally attached to the interior of the buffer housing to pivot down from a horizontal position toward the housing wall and be operated by a motor that responds to the second sensor's signals. The linkage, follower and template are not needed in this alternative embodiment.

Figure 1C:
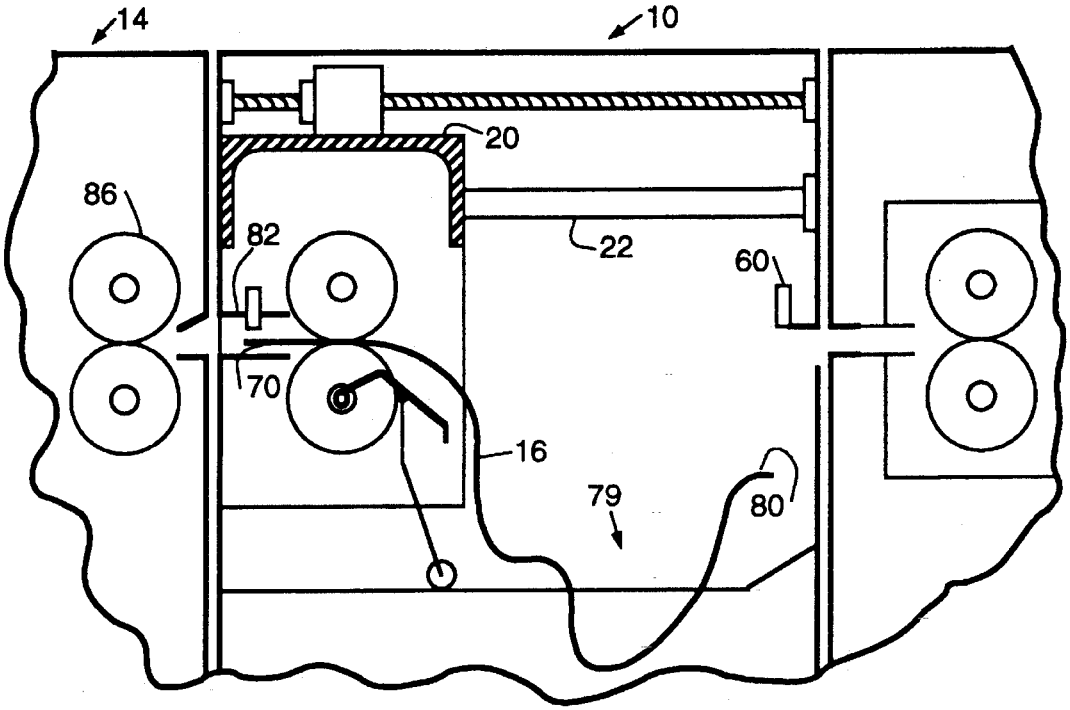

Referring to FIG. 1C, a storage bin, generally indicated as 79, located below the carriage 20 is essentially an open space for the media 16 to form a slack loop in. The trailing end 80 of the media 16 enters the buffer 10 and drops down into the bin 79. The carriage 20 continues to travel along the rails 22 to the processor 14 side where the leading end 70 becomes aligned with an exit guide 82 adjacent to the processor and the carriage 20 is in the delivery position. Then, the processor 14 is checked to see if it is ready to accept the sheet of media 16 stored in the buffer 10. Upon a signal from the first sensor 60 indicating the media 16 is no longer entering the buffer 10 and a signal from the processor 14 indicating it is ready, the brake mechanism 40 (FIG. 4) is shut off and the buffer rollers 26 are rotated to transport the leading end 70 of the sheet into the processor 14. In the meantime, the imagesetter is in the process of imaging the next job and as the transport system of the imagesetter is empty, upon completion the job can be cut from the web and delivered as a sheet to the transport system of the imagesetter.

Figure 1D:
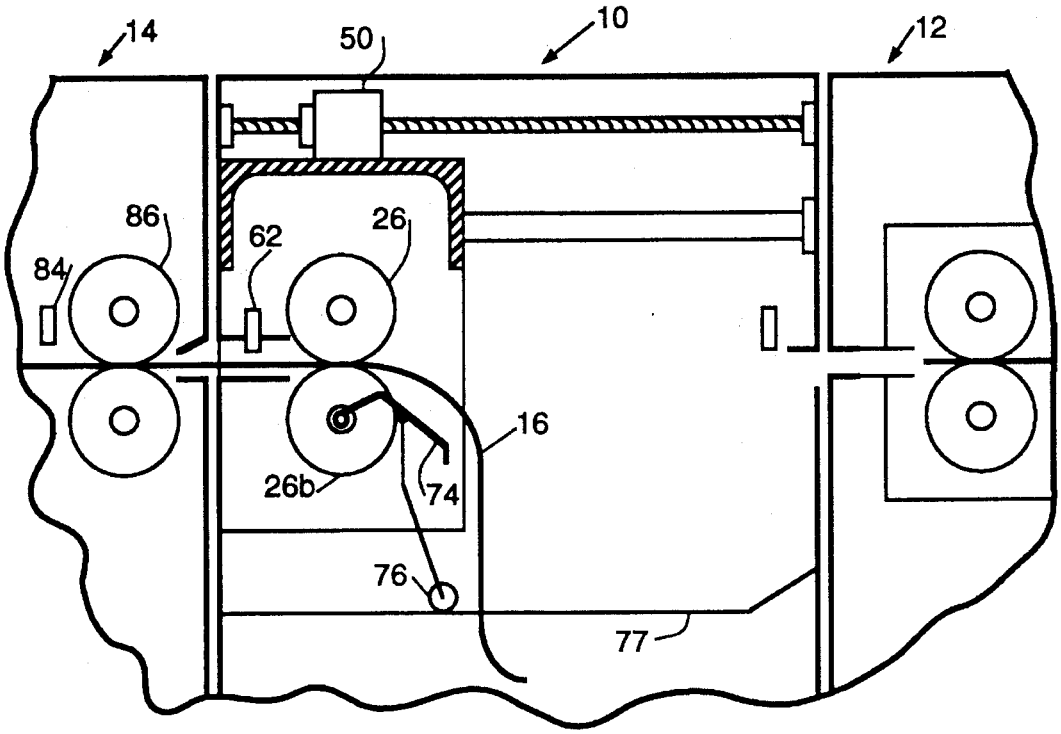

Referring now to FIG. 1D, a processor input sensor 84 senses the media 16 as it enters the processor rollers 86. In response to the sensor's 84 signal, the processor transport rollers 86 are turned on and the rotation of the buffer rollers 26 is stopped. The overrunning clutch assembly 36 (FIG. 3) on the drive roller 26*b* allows the media 16 to be pulled out from the buffer rollers 26. When the sheet of media 16 leaves the buffer rollers 26, the second sensor 62 sees the empty buffer rollers 26 and in response the carriage motor 50 is driven in a reverse direction to begin the return of the carriage 20 to the imagesetter 12 side of the buffer 10. As the carriage 20 is positioned adjacent to the imagesetter 12, the follower 76 on the template 77 causes the movable media guide 74 to pivot to the horizontal position, so that the next sheet of media can be fed into the buffer 10 and the sequence then repeated.

Figure 4:
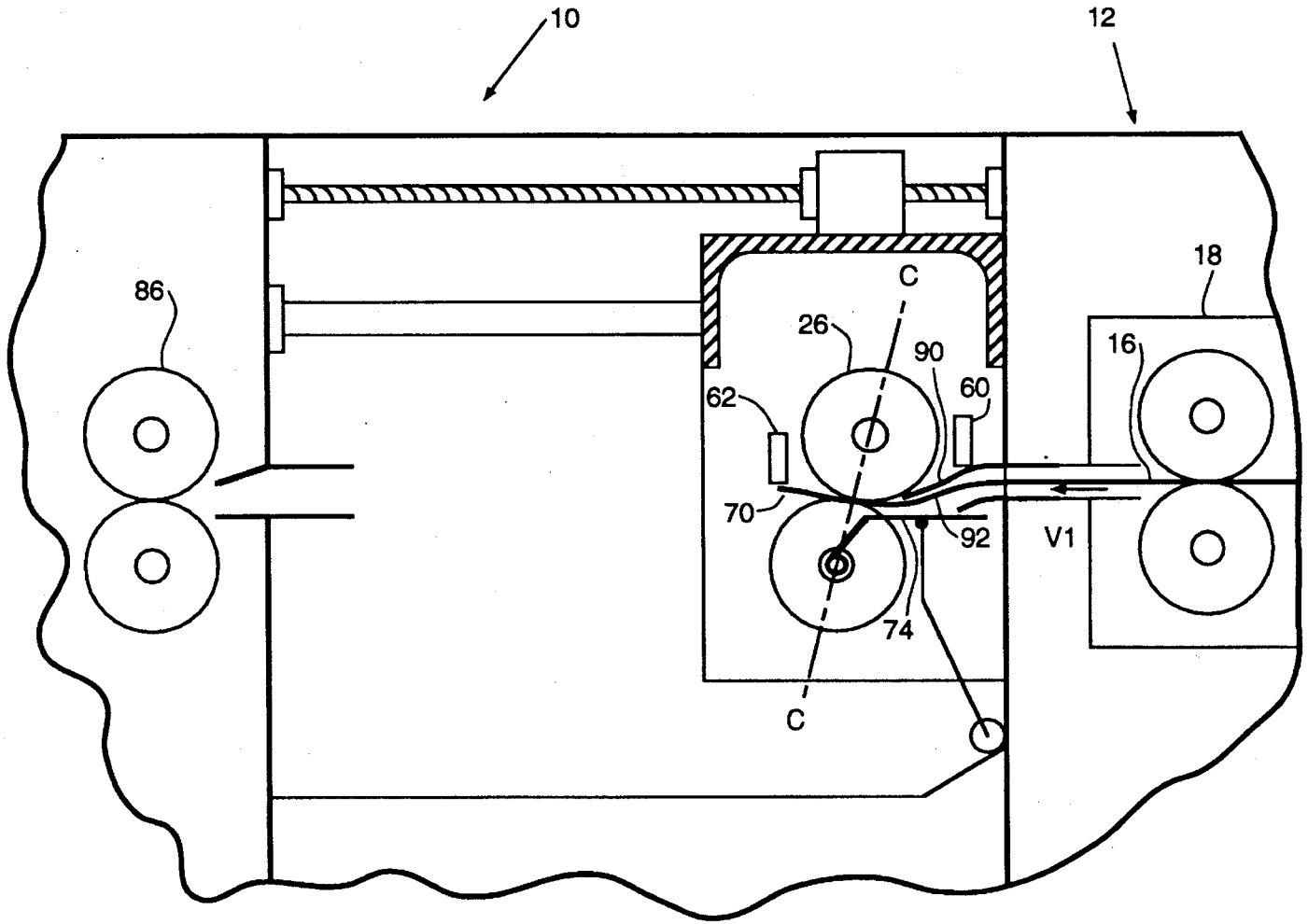
FIG. 4 is a partial sectional side view Of a second embodiment of an external buffer according to the invention in combination with an imagesetter and a processor.

A second embodiment of the media buffer is shown in FIG. 4 in which a feature for media loading is shown. The buffer elements in FIG. 4 are referred to with the same reference numerals as those corresponding elements in FIGS. 1A–D. To assist with loading the media 16 into the buffer 10 from the imagesetter 12, the media 16 is pre-deflected by media guides 90 along the media path to account for the stiffness and the natural curl of the media 16. The buffer rollers 26 are positioned vertically below the media path of the imagesetter 12 relative to the previous embodiment, for cooperation with downward deflecting guides 90. The guides 90 serve to pre-deflect the media 16 to a curved shape opposite from its natural curvature, to prevent buckling of the media 16 during input loading into the buffer 10, and to urge the media 16 into a pre-loop curvature, so that the slack loop 78 will form downwardly, as in FIG. 1B.

The carriage 20 is in the media pick-up position adjacent to the imagesetter 12 to pick-up the leading end 70 of the media 16 from the media transport system 18 of the imagesetter 12. The leading end 70 is fed at speed V1 into the buffer 10 through the downward deflecting media guides 90 of the buffer 10. The first sensor 60 senses the leading end 70 of the media entering the buffer 10 and activates the buffer rollers 26 to rotate. The movable media guide 74 is initially in a horizontal position to serve as a guide for the media 16 into the nip of the rollers 26. The media 16 moves along the guide 74 as the leading end 70 approaches the nip of the rotating buffer rollers 26. The buffer rollers 26 have a center axis C—C that is angled with respect to a vertical axis to further urge the media into the pre-loop curvature 92 as the leading end 70 enters the nip of the buffer rollers 26. The pre-loop configuration 92 is easily formed for thick, stiff media by the combination of buffer rollers being located vertically below the media path of the imagesetter, the downward deflecting media guides, and the angled center axis C—C of the buffer rollers 26.

As in the previous embodiment, the media 16 then passes through the rollers 26 and reaches the second media sensor 62 when the buffer rollers 26 stop to hold the leading end 70 stationary with respect to the buffer rollers 26. Then the process of loading the media is then complete, and continuing operation of the buffer 10 proceeds in the same manner as the previous embodiment to deliver the media to the processor rollers 86. In the embodiment depicted in FIG. 4, the processor rollers 86 can be positioned slightly above the horizontal plane of the buffer rollers to facilitate the loading of the media into the processor rollers.

It will be appreciated by those skilled in the art that in the above described embodiments the buffer rollers that serve as a means for gripping the leading end of the media during loading of the media into the buffer, can alternatively be replaced with a vacuum pick-up mechanism mounted on the carriage which cooperates with the media guides and sensors described in the preferred embodiment. Further, it will be appreciated that the external buffer can be used in many different applications and is not limited to media handling between an imagesetter and a processor.

While this invention has been described in terms of a preferred embodiment, those skilled in the art will appreciate that various modifications, substitutions, omissions and changes may be made without departing from the spirit thereof. Accordingly, it is intended that the scope of the present invention be limited solely by the scope of the following claims, including equivalents thereof.

What we claim and desire to secure by Letters of Patent of the United States are the following:

1. An apparatus for buffering a sheet of media having a leading end and a trailing end, between a first media handling station and a second media handling station, comprising:

a. gripping means for gripping the leading end of the sheet as the sheet advances at a first speed from the first media handling station;

b. first transporting means for transporting said gripping means and the leading end of the sheet at a second speed from the first media handling station to the second media handling station, the second speed being slower than the first speed such that the sheet of media forms a slack loop during transportation of said gripping means and the leading end of the sheet to the second media handling station until the trailing end of the sheet advances out from the first media handling station; and c. second transporting means for transporting the leading end of the sheet to the second media handling station upon said gripping means releasing said leading end.

2. The apparatus according to claim 1 wherein the first media handling station is internal to an image-setting device and the second media handling station is internal to a processing device.

3. The apparatus according to claim 1, further comprising movable media guide means for guiding the leading end of media from the first media handling station to said gripping means while in a first position, and for allowing the slack loop to form in the sheet of media as soon as the first transporting means begins to transport the gripping means and the leading end of the sheet away from the first media handling station to prevent buckling in the media while said movable media guide means is in a second position.

4. The apparatus according to claim 3 wherein the first media handling station is internal to an image-setting device and the second media handling station is internal to a processing device.

5. The apparatus according to claim 1 wherein said gripping means comprises a drive roller and an idler roller paired together forming a nip and said second transporting means comprises roller drive means for rotating the drive roller.

6. The apparatus according to claim 5 further comprising brake means for stopping rotation of the idler roller and the drive roller.

7. The apparatus according to claim 5 further comprising overrunning clutch means for allowing the drive roller to rotate faster than the roller drive means rotates the drive roller.

8. The apparatus according to claim 7 further comprising brake means for stopping rotation of the idler roller and the drive roller.

9. A media transport mechanism comprising:

a. a drive roller and an idler roller paired together forming a nip;

b. roller drive means for rotating the drive roller;

c. first sensor means for sensing a leading end of media approaching the nip of the drive roller and the idler roller and in response thereto signaling said roller drive means to begin rotation of the drive roller;

d. transport means for transporting the drive roller and the idler roller back and forth between a media pick-up position and a media delivery position;

e. movable media guide means for guiding media into the nip of the drive roller and idler roller while said movable guide means is in a first position, and for allowing a slack loop to form in the media as the transport means begins to transport the drive roller and idler roller away from the media pick-up position thereby preventing buckling of the media while said movable guide means is in a second position; and e. second sensor means for sensing the leading end of media exiting the nip and in response thereto signaling the roller drive means to stop rotation of said drive roller, signaling the transport means to transport the drive roller and idler roller from the media pick-up position to the media delivery position, and signaling the movable media guide means to move into the second position.

10. The apparatus according to claim 9 further comprising brake means for stopping rotation of the idler roller and the drive roller.

11. The media transport mechanism according to claim 9 further comprising overrunning clutch means for allowing the drive roller to rotate faster than the roller drive means rotates the drive roller.

12. The apparatus according to claim 11 further comprising brake means for stopping rotation of the idler roller and the drive roller.

13. A method for buffering a sheet of media having a leading end and a trailing end, between a first media handling station and a second media handling station, comprising the steps of:

a. gripping the leading end of the sheet as the sheet continues advancing at a first speed from the first media handling station;

b. transporting the leading end of the sheet at a second speed from the first media handling station to the second media handling station as the sheet continues advancing at a first speed from the first media handling station;

c. forming a slack loop in the sheet of media due to the second speed being slower than the first speed during transportation of the leading end of the sheet to the second media handling station until the trailing end of the sheet advances out from the first media handling station; and d. releasing the leading end of the sheet and transporting the leading end to the second media handling station.

14. A method for buffering a media sheet between a first media handling station and a second media handling station by a pair of media transport rollers carried by a linear transport device, comprising the steps of:

a. positioning the rollers at the first media handling station;

b. feeding the media sheet continuously toward the rollers at a first speed from the first media handling station;

c. rotating the rollers an amount sufficient to grip and hold a leading end of the media sheet stationary relative to the rollers;

d. transporting the rollers and the leading end at a second speed slower than the first speed, away from the first media handling station;

e. forming a slack loop of media between the rollers and the first media handling station until a trailing end of the media sheet is fed toward the rollers from the first media handling station;

f. positioning the rollers at the second media handling station;

g. rotating the rollers to feed the media sheet from the leading end to the trailing end into the second media handling station; and h. transporting the rollers from the second media handling station to the first media handling station.

* * * * *